US007921921B2

(12) United States Patent
Bishop et al.

(10) Patent No.: US 7,921,921 B2
(45) Date of Patent: Apr. 12, 2011

(54) DOWNHOLE BACKUP SYSTEM AND METHOD

(75) Inventors: David S. Bishop, Houston, TX (US); Marc N. Samuelson, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/236,803

(22) Filed: Sep. 24, 2008

(65) Prior Publication Data

US 2010/0071908 A1 Mar. 25, 2010

(51) Int. Cl.
*E21B 33/12* (2006.01)

(52) U.S. Cl. ..... 166/373; 166/138

(58) Field of Classification Search ..... 166/387, 166/196, 191, 137

See application file for complete search history.

(56) References Cited

U.S. PATENT DOCUMENTS

| | | | | |
|---|---|---|---|---|
| 180,169 | A * | 7/1876 | Tasker | 279/2.13 |
| 1,673,802 | A | 6/1928 | Crago | |
| 2,061,289 | A * | 11/1936 | Phipps | 417/189 |
| 3,318,605 | A | 5/1967 | Brown | |
| 3,789,925 | A | 2/1974 | Brown | |
| 4,227,573 | A | 10/1980 | Pearce et al. | |
| 4,288,082 | A | 9/1981 | Setterberg, Jr. | |
| 4,339,107 | A | 7/1982 | Schroder | |
| 4,449,719 | A | 5/1984 | Radosay et al. | |
| 5,433,269 | A | 7/1995 | Hendrickson | |
| 5,857,520 | A | 1/1999 | Mullen et al. | |
| 5,961,123 | A | 10/1999 | Ingram et al. | |
| 6,722,427 | B2 * | 4/2004 | Gano et al. | 166/217 |
| 6,823,938 | B1 | 11/2004 | Milberger | |
| 7,114,559 | B2 * | 10/2006 | Sonnier et al. | 166/206 |
| 7,290,603 | B2 | 11/2007 | Hiorth et al. | |
| 7,357,190 | B2 | 4/2008 | Cook et al. | |
| 7,363,984 | B2 | 4/2008 | Brisco et al. | |
| 7,392,851 | B2 | 7/2008 | Brennan, III et al. | |
| 2005/0087931 | A1 | 4/2005 | Yamauchi et al. | |
| 2005/0133225 | A1 | 6/2005 | Oosterling | |
| 2006/0005963 | A1 * | 1/2006 | Hiorth et al. | 166/196 |
| 2007/0144735 | A1 | 6/2007 | Lloyd et al. | |
| 2008/0073086 | A1 | 3/2008 | Cook et al. | |
| 2008/0110643 | A1 | 5/2008 | Richard et al. | |
| 2008/0156501 | A1 | 7/2008 | Vinson et al. | |

OTHER PUBLICATIONS

BTU, HPHT—Retrievable Packer/Plug, Copyright 2005. Retrieved online on Sep. 17, 2008 from: http://www.btu.no/plugs_vis.asp-?pgid=5&pid=18.

Kinzel, H., et al. "New Ways of Handling and Running C.R.A. Tubulars Prevent Corrosion in H2S and CO2 Environments," SPE 100181, Aberdeen, Scotland, U.K., May 2006.

Burley, J.D., et al. "Recent Developments in Packer Seal Systems for Sour Oil and Gas Wells," SPE 6762, Denver, Colorado, Oct. 9-12, 1977.

Daigle, Chan L., et al. "Expandable Tubulars: Field Examples of Application in Well Construction and Remediation," SPE 62958, Dallas, Texas, Oct. 1-4, 2000.

(Continued)

*Primary Examiner* — David J Bagnell
*Assistant Examiner* — James G Sayre
(74) *Attorney, Agent, or Firm* — Cantor Colburn LLP

(57) ABSTRACT

A downhole backup system includes, a tubular positionable within a downhole structure such that an annular space exists between the tubular and the downhole structure. The downhole backup system also includes, a plurality of wedges that are radially movably positioned within the annular space, and each of two opposing ends of the plurality of wedges are configured to completely cover the annular space at all possible radial positions of the plurality of wedges.

19 Claims, 3 Drawing Sheets

OTHER PUBLICATIONS

Filippov, Andrei, et al. "Expandable Tubular Solutions," SPE 56500, Houston, Texas, Oct. 3-6, 1999.
Harris, David, et al. "New Developments in the Mechanized Running of Tubulars," SPE/IADC 57589, Abu Dhabi, UAE, Nov. 8-10, 1999.
Hilbert, Jr., L.B., et al. "Evaluating Pressure Integrity of Polymer Ring Seals for Threaded Connections in HP/HT Wells and Expandable Casing," IADC/SPE 87214, Dallas, Texas, Mar. 2-4, 2004.

* cited by examiner

DOWNHOLE BACKUP SYSTEM AND METHOD

BACKGROUND OF THE INVENTION

In the downhole hydrocarbon recovery industry elastomeric seals are used to seal annular areas between concentric tubulars. To prevent axial extrusion of the elastomeric seals at high temperatures and high pressures, backups are employed. Backups are radially expanded to fill the annular area during deployment and are radially retracted during tripping thereof. Although a typical backup can adequately prevent a seal from extruding thereby, each backup can only backup one end of one seal, thereby requiring two backups per seal. With each backup having a separate actuation, two actuations are needed to back up the two ends of a single seal. The industry would be receptive of systems that permit a reduction in the number of actuations required to backup multiple seals.

BRIEF DESCRIPTION OF THE INVENTION

Disclosed herein is a downhole backup system. The system includes, a tubular positionable within a downhole structure such that an annular space exists between the tubular and the downhole structure, and a plurality of wedges that are radially movably positioned within the annular space, each of two opposing ends of the plurality of wedges are configured to completely cover the annular space at all possible radial positions of the plurality of wedges.

Further disclosed herein is a method of backing up seals at a downhole tool. The method includes, moving a plurality of wedges radially, and covering perimetrical gaps between adjacent wedges on both longitudinal ends with wings disposed at the plurality of wedges.

Further disclosed herein is a method of occluding a downhole annular space. The method includes, radially moving a plurality of wedges positioned in the downhole annular space, and occluding the downhole annular space at both opposing ends of the plurality of wedges.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
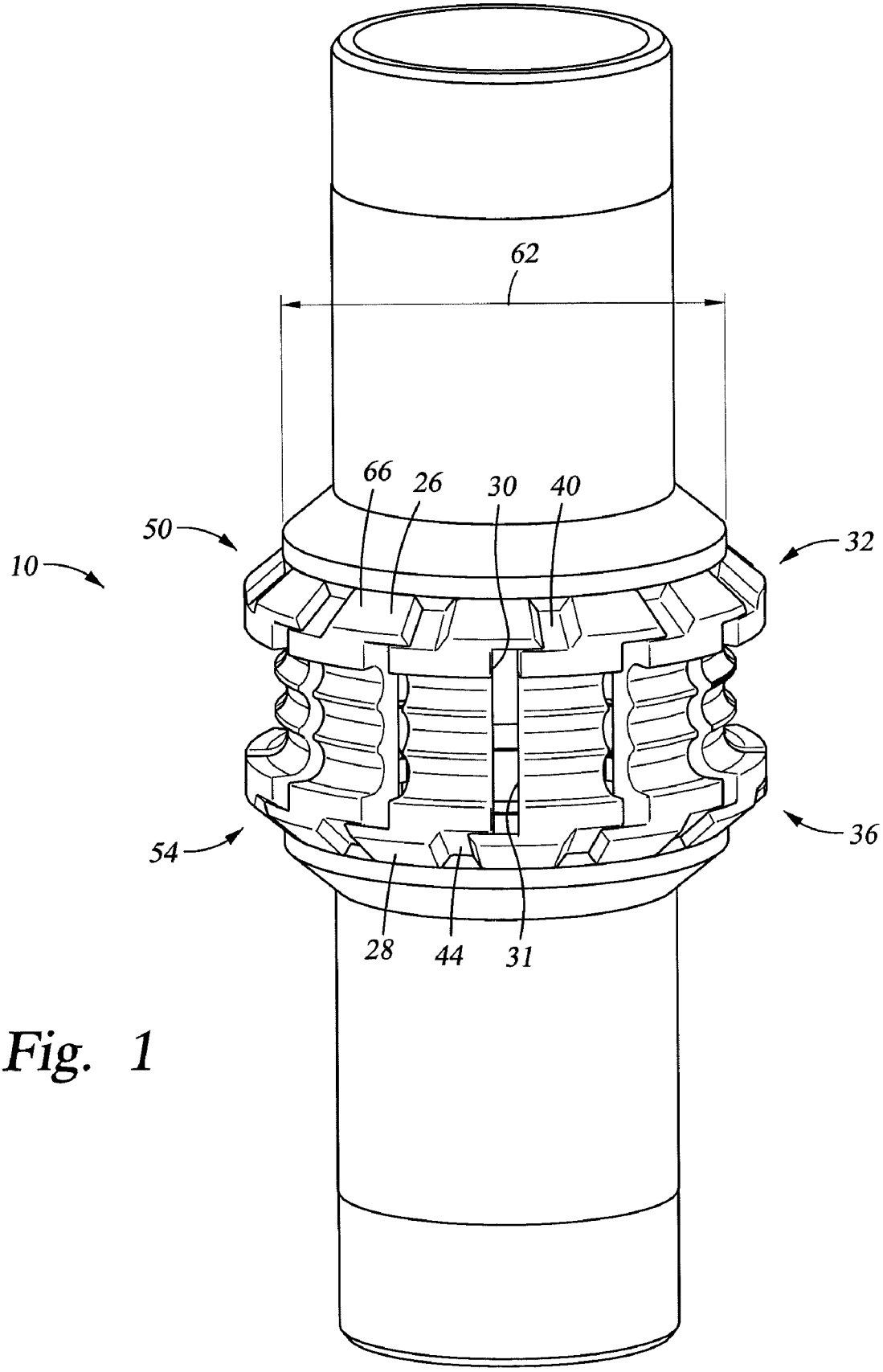
FIG. 1 depicts a perspective view of a downhole dual backup 10 disclosed herein.
Figure 2:
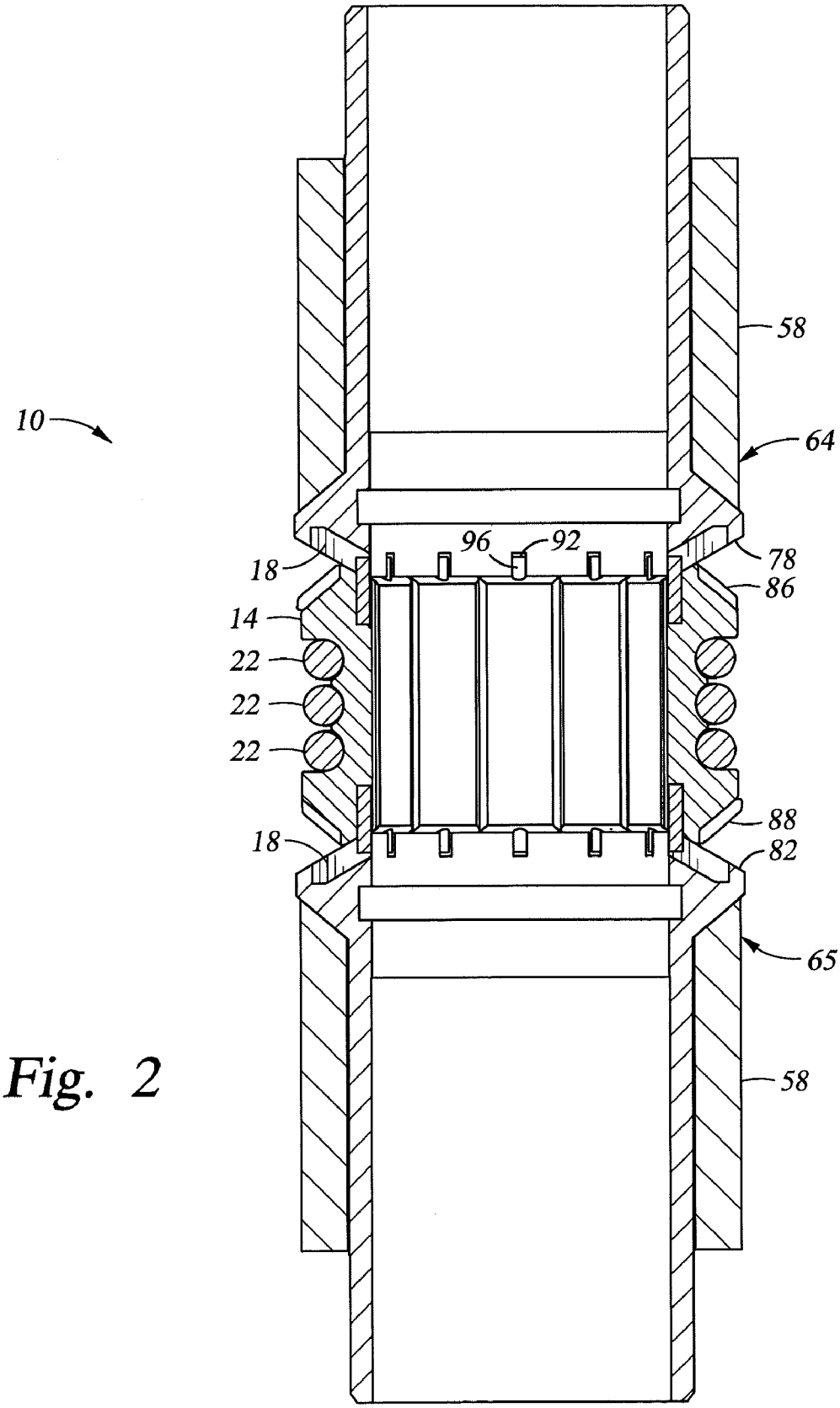
FIG. 2 depicts a cross sectional view of the downhole dual backup of FIG. 1.
Figure 3:
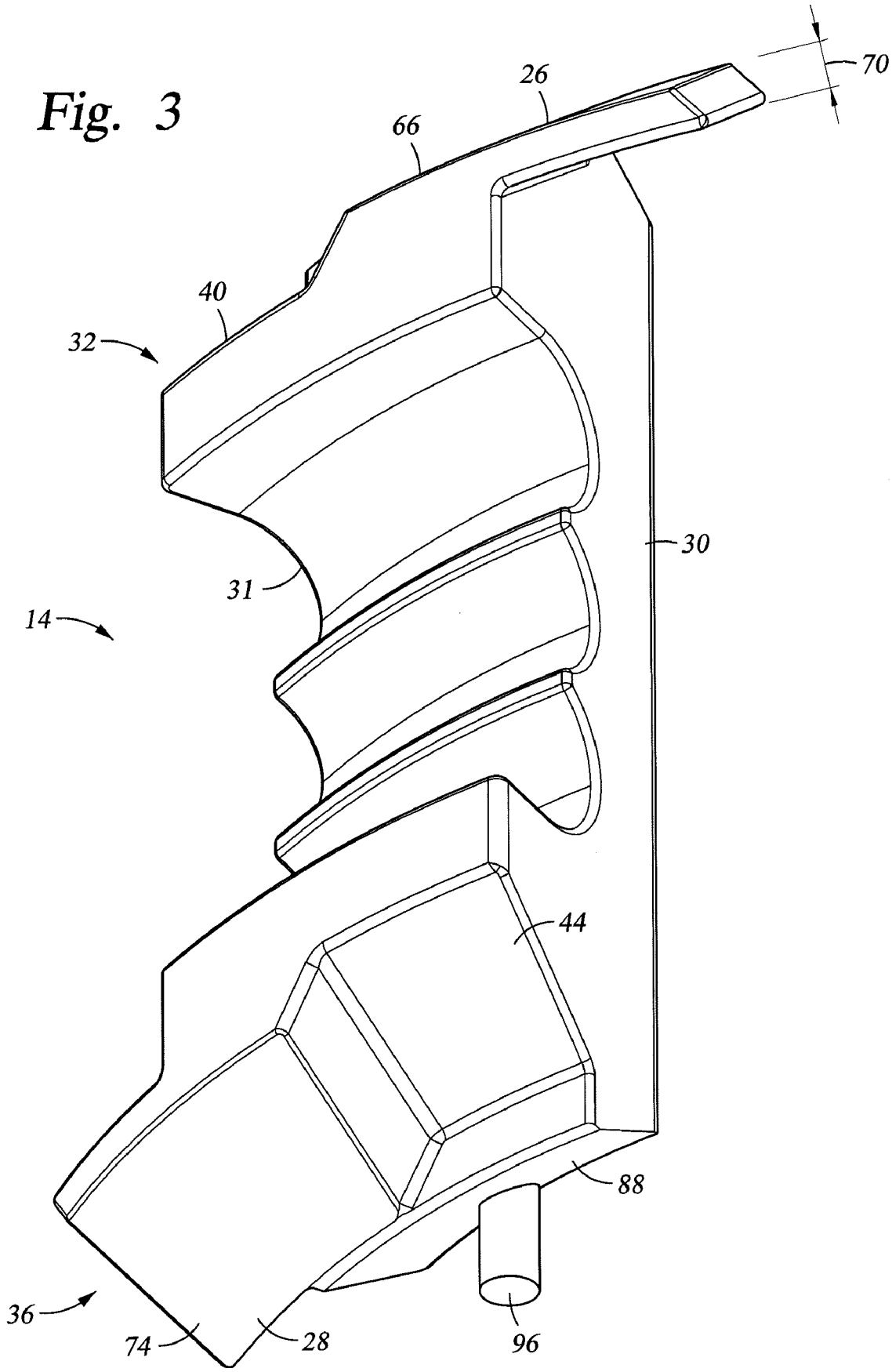
FIG. 3 depicts a perspective view of a wedge of the downhole dual backup of FIG. 1.

Referring to FIGS. 1-3, the downhole dual backup 10 includes, a plurality of wedges 14, positioned perimetrically adjacent to one another, between a pair of ramps 18. One or more biasing member(s) 22, disclosed herein as tension springs (three being illustrated), surround the wedges 14 and bias the wedges 14 radially inwardly. Each wedge 14 has one wing 26, 28 on each end that extends perimetrically beyond edges 30, 31 of the wedges 14, respectively. The wing 26 on a first end 32 extends in a direction opposite to the direction of the wing 28 on a second end 36, although designs having the wings 26, 28 extending in the same direction are possible. Each wedge 14 also has a surface 40 on the first end 32 and a surface 44 on the second end 36. The wedges 14 are configured such that the wing 26 on the first end 32 of one wedge 14 slidably engages with the surface 40 on the first end 32 of an adjacent wedge 14. Similarly, the wing 28 on the second end 36 of one wedge 14 slidably engages with the surface 44 on the second end 36 of an adjacent wedge 14.

The foregoing allows the wedges 14 to provide two continuous perimetrical supports 50, 54 regardless of a specific radial position the wedges 14. As such, elastomeric members 58, shown herein as seals (not shown in FIG. 2), are prevented from extruding through annular openings between an outer dimension 62 of the ramps 18 and an inner surface of a downhole structure, such as a liner, casing or open hole (not shown), for example, within which the backup 10 is positioned. These two continuous perimetrical supports 50, 54 are best seen in FIG. 2 at radial dimensions greater than the outer dimension 62. Since the dual backup 10 has the two continuous perimetrical supports 50, 54, two ends 64, 65, of two different seals 58, can be backed up with just one of the dual backups 10. A surface 66, on the wing 26, creates a portion of the first perimetrical support 50 and the surface 40 forms another portion of the first perimetrical support 50. As such, the perimetrical support 50 is stepped by a thickness 70 of the wing 26 as viewed while proceeding around a perimeter thereof. The wing 26 provides a portion of the perimetrical support 50 that would be unsupported by perimetrical clearance between the edges 30 and 31 if the wing 26 were not present. Similarly, a surface 44 on the wing 28 creates a portion of the second perimetrical support 54 and the surface 44 forms another portion of the second perimetrical support 54. The wings 26, 28 extend sufficiently to overlap with the surface 40, 44 at all radial positions of the wings 26, 28, the radial movement of which will be described below.

Axial movement of the ramps 18 causes radial movement of the wedges 14. As the ramps 18 move toward one another by a linear actuator (not shown), for example, angled surfaces 78 and 82, of the ramps 18, engage with angled surfaces 86, 88 of the wedges 14, respectively. This engagement causes the wedges 14 to simultaneously move radially outwardly causing the springs 22 to lengthen in the process. The lengthening of the springs 22 increases the radial inward bias the springs 22 provide to the wedges 14. Alternately, axial movement of the ramps 18 away from one another allows the wedges 14 to move radially inwardly under the biasing load of the springs 22.

Alignment features 92 in the ramps 18, shown herein as slots (although protrusions or other details could be employed), engage with complementary features 96 in the wedges 14, shown herein as tabs, to maintain substantially equal angular spacing between the wedges 14 as the wedges 14 move radially. This assures that the perimetrical distance between adjacent wedges 14 remains uniform and the wings 26, 28 cover the clearances between edges 30 and 31 at all radial positions of the wedges 14.

By assuring that the wings 26, 28 overlap with the surfaces 40, 44 the full perimetrical supports 50, 54 also form barriers that restrict the ingress of contamination to the backup 10 that could adversely affect the radial actuation of the wedges 14. The elastomeric members 58, by being on both axial ends of the dual backup 10, further protect the backup 10 from contamination. This prevention of ingress of contamination coupled with the fact that there is no plastic deformation of the components during actuation of the dual backup 10 the dual backup 10 is capable of an indefinite number of cycles without degradation. Additionally, the dual back up is fully reusable.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A downhole backup system, comprising:

a tubular positionable within a downhole structure such that an annular space exists between the tubular and the downhole structure;

a plurality of wedges being radially movably positioned within the annular space, each of two opposing ends of each of the plurality of wedges having wings on opposing longitudinal ends and oriented in opposite directions, being configured to completely cover the annular space at all possible radial positions of the plurality of wedges; and a plurality of ramps in operable communication with the plurality of wedges such that axial movement of the plurality of ramps causes the plurality of wedges to move radially.

2. The downhole backup system of claim 1, wherein the plurality of wedges are radially inwardly biased.

3. The downhole backup system of claim 1, wherein the plurality of ramps is two.

4. The downhole backup system of claim 1, wherein axial movement of the plurality of ramps toward one another causes the plurality of wedges to move radially outwardly.

5. The downhole backup system of claim 1, wherein axial movement of the plurality of ramps away from one another allows the plurality of wedges to move radially inwardly.

6. The downhole backup system of claim 1, wherein the plurality of ramps include alignment features in operable communication with the plurality of wedges to maintain perimetrical spacing of the plurality of wedges at all radial positions of the plurality of wedges.

7. The downhole backup system of claim 6, wherein the alignment features are at least one of slots and ridges.

8. The downhole backup system of claim 1, wherein the complete covering of the annular space is preventable of extrusion of a seal therethrough.

9. The downhole backup system of claim 1, wherein each of the plurality of wedges are substantially identical.

10. The downhole backup system of claim 1, further comprising at least one spring configured to bias the plurality of wedges radially inwardly.

11. The downhole backup system of claim 1, wherein each of the plurality of wedges includes at least one wing in operable communication with a perimetrically adjacent wedge the at least one wing covering a gap between the adjacent wedges formed in response to radial outward movement of the plurality of wedges.

12. The downhole backup system of claim 1, wherein movability of the plurality of wedges is reversible.

13. The downhole backup system of claim 1, wherein the downhole backup system is reusable.

14. The downhole backup system of claim 1, wherein the plurality of wedges are positionable between seals to prevent extrusion of the seals thereby.

15. A method of backing up seals at a downhole tool, comprising;

moving a plurality of ramps axially;

moving a plurality of wedges radially; and covering perimetrical gaps between adjacent wedges with wings on opposing longitudinal ends oriented in opposite directions disposed at each of the plurality of wedges.

16. The method of backing up seals at a downhole tool of claim 15, wherein the moving the plurality of ramps is moving of two ramps relative to one another.

17. The method of backing up seals at a downhole tool of claim 15, further comprising biasing the plurality of wedges radially inwardly.

18. The method of backing up seals at a downhole tool of claim 15, further comprising maintaining angular positions of the plurality of wedges while moving the plurality of wedges.

19. A method of occluding a downhole annular space, comprising:

axially moving a plurality of ramps;

radially moving a plurality of wedges positioned in the downhole annular space; and occluding the downhole annular space at both opposing ends of each of the plurality of wedges with wings oriented in opposite directions.

* * * * *